US009211749B1

(12) United States Patent
Fujiwara

(10) Patent No.: US 9,211,749 B1
(45) Date of Patent: Dec. 15, 2015

(54) INK JET PRINTING APPARATUS

(71) Applicant: RISO KAGAKU CORPORATION, Tokyo (JP)

(72) Inventor: Daisuke Fujiwara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/656,001

(22) Filed: Mar. 12, 2015

(51) Int. Cl.
*B41J 29/393* (2006.01)
*B41J 29/38* (2006.01)

(52) U.S. Cl.
CPC ..... *B41J 29/393* (2013.01); *B41J 29/38* (2013.01)

(58) Field of Classification Search
CPC ..... B41J 2/04505; B41J 2/2139; B41J 2/155; B41J 29/393; B41J 2/2146; B41J 29/38
USPC ..... 347/9, 12, 14, 15, 19, 43
See application file for complete search history.

(56) References Cited

U.S. PATENT DOCUMENTS

| | | | | |
|---|---|---|---|---|
| 8,646,868 | B2 | 2/2014 | Tomita et al. | |
| 2010/0039469 | A1* | 2/2010 | Shimosato et al. | 347/14 |
| 2010/0220134 | A1* | 9/2010 | Matsushita | 347/10 |

FOREIGN PATENT DOCUMENTS

| | | |
|---|---|---|
| JP | 2012-116050 | 6/2012 |

* cited by examiner

*Primary Examiner* — Jannelle M Lebron
(74) *Attorney, Agent, or Firm* — Hamre, Schumann, Mueller & Larson, P.C.

(57) ABSTRACT

An ink jet printing apparatus calculates the distribution of ink droplet numbers for every page and every color component when printing target image data is generated, determines whether or not pixel numbers corresponding to the ink droplet numbers are 0 in all color components and all pages in order of a greater ink droplet number from a maximum ink droplet number, based on the distribution of the calculated ink droplet numbers of all the pages, and determines, as a new maximum ink droplet number, a greatest ink droplet number among ink droplet numbers which are ink droplet numbers equal to or smaller than the maximum ink droplet number and of which pixel numbers are not 0, based on a determination result.

6 Claims, 6 Drawing Sheets

FIG.2A

| INK DROPLET NUMBER | PIXEL PERCENTAGE[%] |
|---|---|
| 7 | 0 |
| 6 | 10 |
| 5 | 17 |
| 4 | 8 |
| 3 | 5 |
| 2 | 15 |
| 1 | 22 |
| 0 | 23 |
| TOTAL | 100 |

SET MAXIMUM INK DROPLET NUMBER TO 6

FIG.2B

| INK DROPLET NUMBER | PIXEL PERCENTAGE[%] |
|---|---|
| 7 | 3 |
| 6 | 10 |
| 5 | 19 |
| 4 | 8 |
| 3 | 5 |
| 2 | 10 |
| 1 | 22 |
| 0 | 23 |
| TOTAL | 100 |

MAXIMUM INK DROPLET NUMBER IS NOT CHANGED

FIG.2C

| INK DROPLET NUMBER | PIXEL PERCENTAGE[%] |
|---|---|
| 7 | 15 |
| 6 | 10 |
| 5 | 11 |
| 4 | 8 |
| 3 | 5 |
| 2 | 15 |
| 1 | 13 |
| 0 | 23 |
| TOTAL | 100 |

MAXIMUM INK DROPLET NUMBER IS NOT CHANGED

FIG.4A

| INK DROPLET NUMBER | PIXEL PERCENTAGE[%] |
|---|---|
| 7 | 0 |
| 6 | 10 |
| 5 | 17 |
| 4 | 8 |
| 3 | 5 |
| 2 | 15 |
| 1 | 22 |
| 0 | 23 |
| TOTAL | 100 |

SET MAXIMUM INK DROPLET NUMBER TO 6

FIG.4B

| INK DROPLET NUMBER | PIXEL PERCENTAGE[%] |
|---|---|
| 7 | 3 |
| 6 | 10 |
| 5 | 19 |
| 4 | 8 |
| 3 | 5 |
| 2 | 10 |
| 1 | 22 |
| 0 | 23 |
| TOTAL | 100 |

SET MAXIMUM INK DROPLET NUMBER TO 6

FIG.4C

| INK DROPLET NUMBER | PIXEL PERCENTAGE[%] |
|---|---|
| 7 | 15 |
| 6 | 10 |
| 5 | 11 |
| 4 | 8 |
| 3 | 5 |
| 2 | 15 |
| 1 | 13 |
| 0 | 23 |
| TOTAL | 100 |

MAXIMUM INK DROPLET NUMBER IS NOT CHANGED

INK JET PRINTING APPARATUS

BACKGROUND OF THE INVENTION

1. Field of the Invention

The present invention relates to a multi-droplet type ink jet printing apparatus, and particularly, to an ink jet printing apparatus that changes a maximum ink droplet number to accelerate the completion of a print job.

2. Related Art

In the related art, in ink jet printing apparatuses, a multi-droplet type that is a driving type for performing gradation expression is known. In the multi-droplet type, the control of the number of ink droplets that is the same discharge amount of ink to be discharged to the same position corresponding to each pixel is performed (for example, JP-A-2012-116050).

SUMMARY OF THE INVENTION

However, there are the following problems in a case of the multi-droplet type ink jet printing apparatus. In the case of the multi-droplet type ink jet printing apparatus, the discharge speed of ink droplets is determined as a predetermined value so as to suppress deviation of landing positions or contamination caused by mist or the like in consideration of a flight state of ink or the like. Additionally, a maximum value of the numbers of ink droplets that are dischargeable to the same position is set so as to bring about an optimal printing density in consideration of the blurring of ink to paper.

For this reason, as the maximum ink droplet number to be set is greater, the time taken until the discharge to the same position is completed is also greater. Therefore, it is necessary to make slow the speed (downward conveying speed of a head) at which printing paper is conveyed downward of an ink jet head.

As a result, when the maximum ink droplet number is set in advance, there is a problem in that, irrespective of a state where the maximum ink droplet number is not completely used or hardly used depending on a print job, the printing paper is conveyed at the downward conveying speed of the head corresponding to the maximum ink droplet number, and the processing of the print job becomes slow.

The invention has been made in view of the above problems, and an object thereof is to provide a multi-droplet type ink jet printing apparatus that may change a maximum ink droplet number to thereby accelerate the processing time of a print job, in a state where the maximum ink droplet number is not completely used or hardly used in the print job.

According to a first aspect of the present invention, there is provided an ink jet printing apparatus including a generation unit configured to generate printing target image data including an image page, on which ink droplet numbers are recorded for respective pixels, according to a print resolution for every page and every color component; a printing unit configured to perform printing on a printing paper by discharging ink, having ink droplet numbers corresponding to the respective pixels with a maximum ink droplet number determined based on the printing paper as an upper limit, to positions on the printing paper corresponding to the respective pixels in the printing target image data; a conveying speed determination unit configured to determine a conveying speed of the printing paper during printing processing performed by the printing unit, based on the maximum ink droplet number; an ink droplet number distribution calculation unit configured to calculate a distribution of the ink droplet number for every page and every color component when the printing target image data is generated by the generation unit;

a pixel number determination unit configured to determine whether or not pixel numbers corresponding to the ink droplet numbers are 0 in all color components and all pages in order of a greater ink droplet number from the maximum ink droplet number, based on a distribution of ink droplet numbers of all the pages calculated by the ink droplet number distribution calculation unit; a maximum ink droplet number determination unit configured to determine, as a new maximum ink droplet number, a greatest ink droplet number among ink droplet numbers which are ink droplet numbers equal to or smaller than the maximum ink droplet number and of which pixel numbers are not 0, based on a determination result obtained by the pixel number determination unit; and a control unit configured to control the printing unit and the conveying speed determination unit based on the new maximum ink droplet number.

Additionally, according to a second aspect of the present invention, in the first aspect, the generation unit may generate the printing target image data based on different print resolutions according to the color components, the printing unit may perform printing on the printing paper by discharging ink, having ink droplet numbers corresponding to the respective pixels, to positions on the printing paper corresponding to the respective pixels in the printing target image data, for every color component, with a maximum ink droplet number determined based on the printing paper and the print resolution as an upper limit, and the conveying speed determination unit may determine the conveying speed of the printing paper during the printing processing performed by the printing unit, using a maximum ink droplet number, which is greatest among maximum ink droplet numbers determined for every color component, as the maximum ink droplet number.

Additionally, according to a third aspect of the present invention, there is provided an ink jet printing apparatus including a generation unit configured to generate printing target image data including an image page, on which ink droplet numbers are recorded for respective pixels, according to a print resolution for every page and every color component; a printing unit configured to perform printing on printing paper by discharging ink, having ink droplet numbers corresponding to the respective pixels with a first maximum ink droplet number determined based on the printing paper as an upper limit, to positions on the printing paper corresponding to the respective pixels in the printing target image data; a conveying speed determination unit configured to determine the conveying speed of the printing paper during printing processing performed by the printing unit, based on the first maximum ink droplet number; an ink droplet number distribution calculation unit configured to calculate the distribution of the ink droplet numbers for every page and every color component when the printing target image data is generated by the generation unit; a determination unit configured to determine whether or not pixel numbers corresponding to the ink droplet numbers are equal to or smaller than a predetermined threshold value in all color components and all pages in order of a greater ink droplet number from the first maximum ink droplet number, based on the distribution of the ink droplet numbers of all the pages calculated by the ink droplet number distribution calculation unit; a maximum ink droplet number determination unit configured to determine, as a second maximum ink droplet number, a greatest ink droplet number among ink droplet numbers which are ink droplet numbers equal to or smaller than the first maximum ink droplet number and of which pixel numbers are not equal to or less than the predetermined threshold value, based on a determination result obtained by the pixel number determination unit; a difference time calculation unit configured to calculate a difference time obtained by subtracting a time when printing of all the pages of the printing paper is completed at a conveying speed corresponding to the second maximum ink droplet number from a time when printing of all the pages of the printing paper is completed at a conveying speed corresponding to the first maximum ink droplet number; a reproduction unit configured to associate the second maximum ink droplet number with an allocation target pixel, which is a pixel corresponding to an ink droplet number that is greater than the second maximum ink droplet number and of which the pixel number is equal to or greater than a predetermined value, within the printing target image data, and allocating a difference value between an ink droplet number corresponding to the allocation target pixel and the second maximum ink droplet number to pixels around the allocation target pixel, to reproduce the printing target image data; a difference time determination unit configured to determine whether or not a reproduction time required for reproducing the printing target image data by the reproduction unit is smaller than the difference time calculated by the difference time calculation unit; and a control unit configured to, when it is determined by the difference time determination unit that the reproduction time is smaller than the difference time, make the reproduction unit perform reproduction processing and controlling the printing unit and the conveying speed determination unit based on the second maximum ink droplet number.

Additionally, according to a fourth aspect of the present invention, in the third aspect, the generation unit may generate the printing target image data based on different print resolutions according to the color components, the printing unit may discharge ink, having ink droplet numbers corresponding to the respective pixels, to positions on the printing paper corresponding to the respective pixels in the printing target image data, for every color component, with a maximum ink droplet number determined based on the printing paper and the print resolution as an upper limit, to perform printing on the printing paper, and the conveying speed determination unit may determine the conveying speed of the printing paper during the printing processing performed by the printing unit, using a maximum ink droplet number, which is greatest among maximum ink droplet numbers determined for every color component, as the maximum ink droplet number.

Additionally, according to a fifth aspect of the present invention in the third or fourth aspect, a page number of an image page, the size of the printing paper to be printed on, and the print resolution may be included in the printing target image data, the ink jet printing apparatus may further include a storage unit configured to store therein a prediction time table showing a time predicted to be required for reproducing the printing target image data by the reproduction unit according to the page number of the image page, the size of the printing paper, and the print resolution, and the difference time determination unit may determine a time corresponding to the page number, the size of the printing paper, and the print resolution, which are included in the printing target image data, as the reproduction time, with reference to the prediction time table.

Additionally, according to a sixth aspect of the present invention in the fifth aspect, the ink jet printing apparatus may further include a prediction time table generation unit configured to generate the prediction time table by classifying a time required for performing the reproduction processing by the reproduction unit, according to the page number of the image page, the size of the printing paper, and the print resolution after the processing of the ink droplet number distribution calculation unit, the pixel number determination unit, and the maximum ink droplet number determination unit is performed on a plurality of pieces of printing target image data in advance, and the prediction time table generated by the prediction time table generation unit may be stored in the storage unit.

According to the first aspect of the invention, a greatest ink droplet number among ink droplet numbers which are ink droplet numbers equal to or smaller than the maximum ink droplet number and of which pixel numbers are not 0 is determined as a new maximum ink droplet number, based on a determination result by the pixel number determination unit, and the printing unit and the conveying speed determination unit are controlled based on the new maximum ink droplet number.

According to the invention, the following operation effects are provided. The processing performed by the generation unit, the printing unit, and the conveying speed determination unit is required for the processing of all print jobs. Since the processing by the ink droplet number distribution calculation unit may be performed in the case of the processing of the generation unit, it takes little time. Additionally, time is also hardly taken in the processing performed by the pixel number determination unit and the processing performed by the maximum ink droplet number determination unit.

For this reason, when the maximum ink droplet number is set in advance and when the maximum ink droplet number that is set first is not used at all over all the pages of the printing target image data, the conveying speed of the printing paper may be increased by making the maximum ink droplet number small. As a result, the speed of processing of a print job may be increased by conveying the printing paper at the above conveying speed during printing.

According to the second and fourth aspects of the invention, even when the printing target image data is generated with different print resolutions according to the color components, and different maximum ink droplet numbers are set according to the color components, it is possible to obtain the same effects as the first aspect.

According to the third, fifth and sixth aspects of the invention, a greatest ink droplet number among ink droplet numbers which are ink droplet numbers equal to or smaller than the maximum ink droplet number and of which pixel numbers are not equal to or smaller than a predetermined threshold value is determined as a second maximum ink droplet number, based on a determination result by the pixel number determination unit, by the reproduction of the printing target image data, and an ink droplet number serving as a difference is allocated to surrounding pixels regarding a region having the second maximum ink droplet number. As a result, degradation of image quality resulting from changing the maximum ink droplet number may be suppressed.

Additionally, the processing of reproducing the printing target image data is required only when the maximum ink droplet number is changed, and is performed separately from the processing of the generation unit or the like. It may be said that the time required for reproducing the printing target image data is great because a plurality of pieces of image data are all processed in units of pixels.

For this reason, when it is determined the reproduction time required for reproducing the printing target image data by the reproduction unit is smaller than the difference time calculated by the difference time calculation unit, the reproduction unit is made to perform the reproduction processing and the printing unit and the pixel number determination unit are controlled based on the second maximum ink droplet number.

As a result, when the maximum ink droplet number is reduced and the printing target image data is reproduced, the processing of a print job becomes faster than performing the processing of a print job with an original maximum ink droplet number. Accordingly, the speed of processing of a print job may be increased, and degradation of image quality resulting from changing the maximum ink droplet number may be suppressed.

BRIEF DESCRIPTION OF THE DRAWINGS

FIGS. 2A to 2C are supplementary views for describing maximum droplet number determination processing according to the first embodiment;

FIGS. 4A to 4C are supplementary views for describing maximum droplet number determination processing according to a second embodiment;

DETAILED DESCRIPTION OF THE INVENTION

Figure 1:
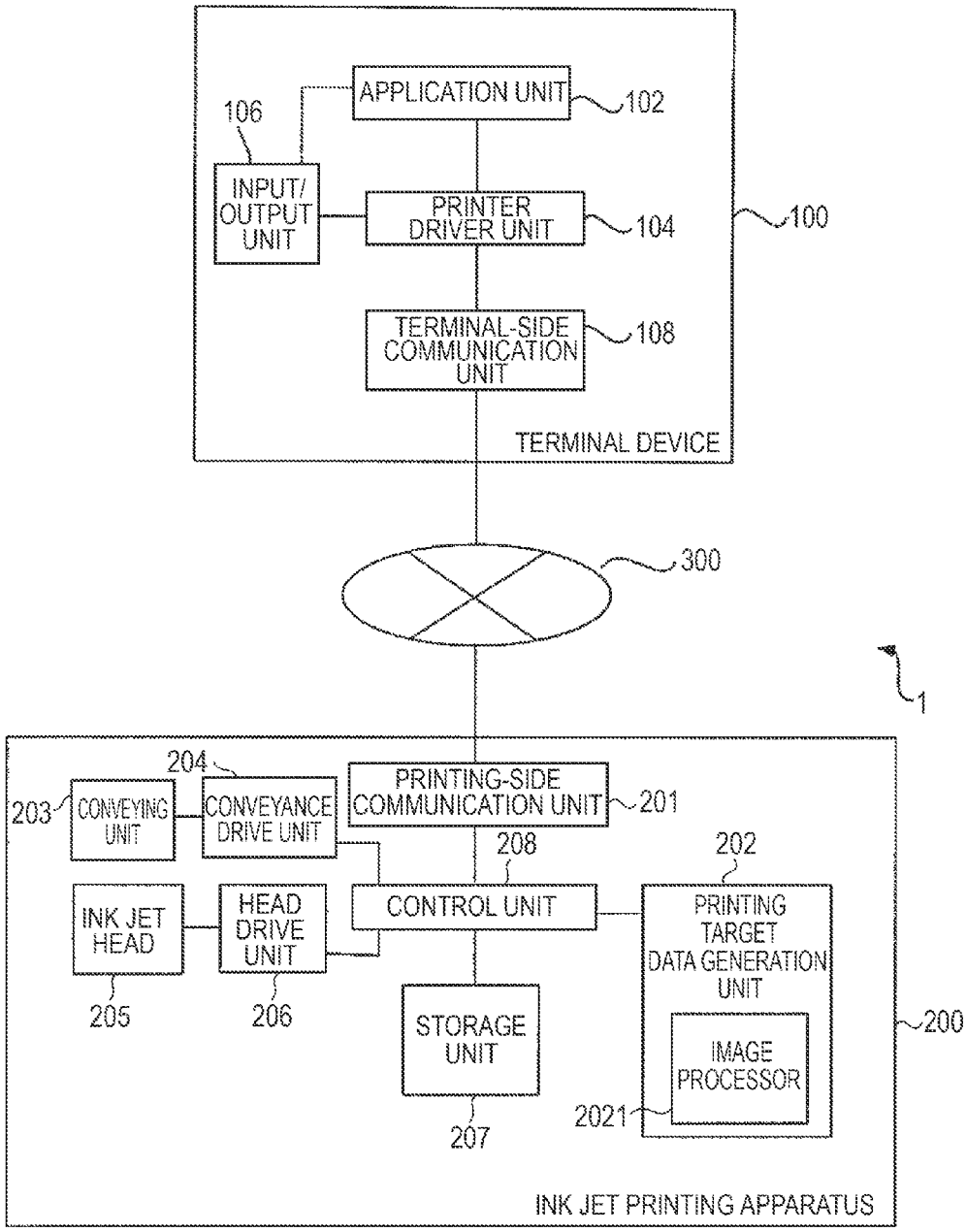
FIG. 1 is a block diagram illustrating the configuration of a printing system according to a first embodiment.

Hereinafter, printing systems of the present embodiments will be described in detail with reference to the drawings. FIG. 1 is an overall configuration view of a printing system 1 of a first embodiment.

First Embodiment

Configuration of Printing System

As illustrated in FIG. 1, the printing system 1 includes a terminal device 100 in which an operation system for performing basic operations of a user interface or the like is incorporated and various software may be executed, an ink jet printing apparatus 200, and a communication path 300 that connects the terminal device and the ink jet printing apparatus via networks, such as a cable LAN.

Terminal Device

The terminal device 100 includes an application unit 102, a printer driver unit 104, an input/output unit 106, and a terminal-side communication unit 108. The application unit 102 and the printer driver unit 104 are configured such that a program installed in the terminal device 100 performs processing, such as decoding, by a CPU or the like.

The application unit 102 includes a program that generates original document data, such as documents, images, or the like. The original document data generated in the application unit 102 is output to the printer driver unit 104.

The printer driver unit 104 makes an output function of the input/output unit 106 perform display of a printing manipulation screen, a printing setting screen, or the like, receives the setting of printing from a user via an input function of the input/output unit 106, and notifies a user of setting information on the printing or a printing state via the output function of the input/output unit 106. The printer driver unit 104 generates print job data (for example, PDL data) based on the printing setting information input by the user, and the original document data.

The input/output unit 106 includes the input function and the output function. The input function is configured with a keyboard or the like, and the output function is configured with a liquid crystal display monitor or the like. The input/output unit 106 enables various data to be input by the user, and outputs this input data to the printer driver unit 104 or the application unit 102. Additionally, the input/output unit 106 notifies the user of an output result from the printer driver unit 104 or the application unit 102.

The terminal-side communication unit 108 transmits the print job data generated by the printer driver unit 104 to the ink jet printing apparatus 200 via the communication path 300.

Ink Jet Printing Apparatus

The inkjet printing apparatus 200 performs printing on the printing paper by discharging ink, having ink droplet numbers corresponding to respective pixels, to positions on printing paper corresponding to the respective pixels in printing target image data to be described below, with a maximum ink droplet number determined according to the printing paper as an upper limit. Here, a pixel number in the printing target image data is determined according to a print resolution.

Specifically, the ink jet printing apparatus 200 includes a printing-side communication unit 201, a printing target data generation unit 202, a conveyance drive unit 204 that drives a conveying unit 203, a head drive unit 206 that drives an ink jet head 205, a storage unit 207 that stores various information, and a control unit 208 that controls respective units.

In the present embodiment, a case where the ink jet head 205 is a line-type ink jet head 205 will be described as an example. The printing-side communication unit 201 receives print job data transmitted from the terminal device 100 via the communication path 300.

A first table on which a paper type and the maximum ink droplet number are associated with each other and a second table on which the maximum ink droplet number, a paper length (for example, the length of A4 in a horizontal direction or the length of A3 in the horizontal direction) in a conveying direction, and side information showing both sides and one side, and a conveying speed (hereinafter referred to as a conveying speed) of paper are associated with each other are stored in the storage unit 207. Here, in the ink jet printing apparatus 200, a speed (or discharge frequency showing ink droplet number per unit time) at which one droplet is discharged is determined according to the type of ink. In the present embodiment, the type of ink to be used is fixed, and the droplet discharge speed is fixed. For example, in the case of the line-type ink jet printer, it is necessary to perform a discharge operation according to ink droplet numbers 0 to 7 per line in a direction perpendicular to the conveying direction of printing paper. For this reason, it is necessary to determine the conveying speed so that droplets of ink droplet number 7 that is the maximum ink droplet number may be discharged while moving from a predetermined line to a next line along the conveying direction on the printing paper.

Additionally, in the present embodiment, the conveying speed is defined as follows. PPM (PAGE PER MINUTE) is a unit showing the number of printed sheets in one minute from when printing is performed and paper ejection is completed after paper feed is started. If the conveying speed is defined using PPM, for example, the conveying speed becomes 150 PPM when the number of printed sheets in one minute until paper ejection is completed after paper feed is started is 150. Additionally, in the case of a conveying speed of 150 PPM, for example, the print job completion time until printing is performed and paper ejection is completed after paper feed is started with respect to 40 sheets of printing paper becomes 40×60/150 (seconds).

The printing target data generation unit 202 generates the printing target image data for making the ink jet head 205 perform printing based on the print job data. Specifically, the printing target data generation unit 202 includes an image processor 2021.

The image processor 2021 develops bit map data of the above print resolution, based on the print job data (PDL data) that the printing-side communication unit 201 has received. For example, when all print resolutions of color components of CMYK are 300 DPI, the bit map data of a pixel number corresponding to 300 DPI is developed.

Specifically, the image processor 2021 repeats, with respect to all pixel positions, the operation of converting the print job data into a red (hereinafter, R) component, a green (hereinafter, G) component, and a blue component (hereinafter, B) at a pixel position (0, 0) and then converting the converted components into a cyan (hereinafter, C) component, a magenta (hereinafter, M) component, a yellow (hereinafter, Y) component, and a black (hereinafter, K) component, and performing multi-value half-tone processing (converting respective component values 0 to 255 into respective component values 0 to 7) in which gradation is reduced. This generates the printing target image data that is raster data for every page and every color component.

Here, in the printing target image data, a C component value (for example, 0 to 7) to a K component value (for example, 0 to 7) are associated with each other for every pixel position developed with the print resolution. As will be described below, the C component value to the K component value become the ink droplet numbers discharged by a C component discharge head module to a K component discharge head module of the ink jet head 205.

In this case, the image processor 2021 calculates the distribution of ink droplet numbers for every page and every color component (ink droplet number distribution calculation processing) when the printing target image data is generated. The specific description of this processing will be illustrated below.

The image processor 2021 calculates the C to K component values (0 to 7) at the pixel position (0, 0) as mentioned above. Thereafter, the image processor 2021 counts a pixel with ink droplet number 6 as 1, for example, when the C component value at the pixel position (0, 0) is 6. The image processor 2021 also performs the same counting processing with respect to an M component value and the K component value. Then, the image processor 2021 performs the above-described counting processing after the calculation of the C to K component values (0 to 7), with respect to all the pixel positions.

As a result, the image processor 2021 generates, for every page, ink droplet number distribution data showing the pixel number with respect to ink droplet numbers 0 to 7, for each of the C to K components.

The control unit 208 determines whether or not pixel numbers corresponding to the ink droplet numbers are 0 in all pages regarding all the color components in order of a greater ink droplet number from the maximum ink droplet number, based on the ink droplet number distribution data (pixel number determination processing).

Additionally, the control unit 208 determines, as a new maximum ink droplet number, a greatest ink droplet number among ink droplet numbers which are ink droplet numbers equal to or smaller than the maximum ink droplet number and of which pixel numbers are not 0, based on the above determination result (maximum droplet number determination processing).

For example, FIGS. 2A to 2C illustrate three examples in which ink droplet number distribution data (ink droplet number distribution data regarding one predetermined color component) generated regarding print job data of page number 1. Here, pixel percentage shows the percentage of the pixel number of each ink droplet number to the total pixel number of one page. It should be noted that the pixel number itself may be used instead of the pixel percentage.

In FIG. 2A, since an ink droplet number of which the pixel percentage is 0 with respect to the maximum ink droplet number 7 is ink droplet number 7, 6 may be a new maximum ink droplet number. Meanwhile, in FIGS. 2B and 2C, there is no ink droplet number of which the pixel number is 0 with respect to the maximum ink droplet number 7. Thus, the new maximum ink droplet number is still 7.

In addition, in FIG. 2A, ink droplet numbers of which pixel percentages are 0 with respect to ink drop numbers 7 and 6 and which are consecutive from the maximum ink droplet number are ink droplet numbers 7 and 6. Thus, 5 may be a new maximum ink droplet number. Meanwhile, in FIG. 2A, an ink droplet number of which the pixel percentage is 0 with respect to the maximum ink droplet numbers 7 and 5 and which is consecutive from the maximum ink droplet number is only ink droplet number 7. Thus, a new maximum ink droplet number becomes 6.

The control unit 208 controls the head drive unit 206 and the conveyance drive unit 204 based on the determined new maximum ink droplet number. Specifically, the control unit 208 makes the head drive unit 206 drive the ink jet head 205 so that the ink jet head 205 may perform discharge processing of ink droplets from a head module (not shown) for each of the C to K components at a timing such that droplets of the new maximum ink droplet number may be discharged onto the same line of printing paper. Additionally, the control unit 208 controls the conveyance drive unit 204 so that the conveyance drive unit 204 drives the conveying unit 203 at a conveying speed such that the ink jet head 205 may discharge droplets of the maximum ink droplet number onto the same line of the printing paper.

Ink Jet Printing Method

Figure 3:
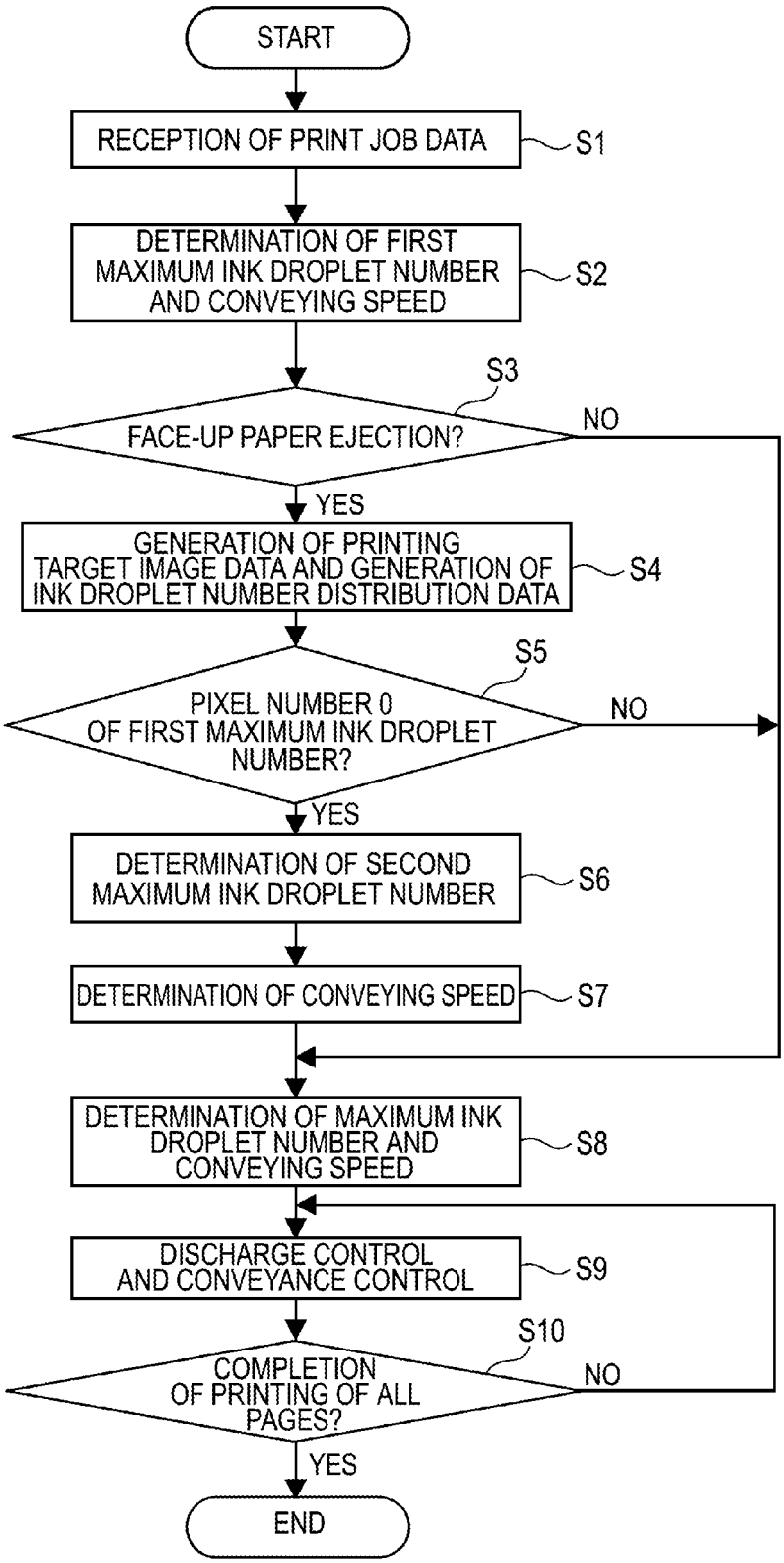
FIG. 3 is a flowchart illustrating an ink jet printing method according to the first embodiment.

FIG. 3 is a flowchart illustrating a printing method using this printing system. After the print job data is generated in the printer driver unit 104 of the terminal device 100, the print job data is transmitted by the terminal-side communication unit 108. The page number of printing paper to be printed on, face-up paper ejection information showing whether a face-up paper ejection tray is specified, paper type information showing the type of the paper, the length of the paper in the conveying direction, the side information, and the size (for example, A4 or B4) of the printing paper to be printed on are included in the print job data.

In Step S1, the printing-side communication unit 201 of the ink jet printing apparatus 200 receives print job data.

In Step S2, the control unit 208 determines a maximum ink droplet number corresponding to a paper type from the paper type information included in the print job data with reference to the first table. The control unit 208 sets the determined maximum ink droplet number in the head drive unit 206. Additionally, the control unit 208 determines a conveying speed corresponding to the determined maximum ink droplet number, the length of the paper in the conveying direction, and the side information, with reference to the second table, and sets the determined conveying speed in the conveyance drive unit 204. Hereinafter, the maximum ink droplet number determined in this step is referred to as a first maximum ink droplet number.

In Step S3, the control unit 208 determines whether or not the paper is ejected to the face-up paper ejection tray, based on the face-up paper ejection information included in the print job data. When the answer is determined to be NO, the processing shifts to Step S8.

When the answer is determined to be YES, the image processor 2021 generates printing target image data for every page and every color component based on the print job data in Step S4, based on a command from the control unit 208. In this case, the image processor 2021 also generates ink droplet number distribution data while generating printing target image data.

In Step S5, the image processor 2021 determines whether or not the pixel number of the first maximum ink droplet number is 0 in all pages regarding C, M, Y, and K components, based on the printing target image data. When the pixel number is determined to be 0, the processing shifts to Step S6. When it is determined that the pixel number is not 0, the processing shifts to Step S8.

In Step S6, the image processor 2021 determines, as a new maximum ink droplet number (hereinafter, a second maximum ink droplet number), a greatest ink droplet number among ink droplet numbers which are ink droplet numbers equal to or smaller than the first maximum ink droplet number and of which pixel numbers are not 0, and sends the determined new maximum ink droplet number to the control unit 208.

In Step S7, the control unit 208 determines a conveying speed corresponding to the second maximum ink droplet number, the length of the paper in the conveying direction, and the side information, with reference to the second table stored in the storage unit 207.

In Step S8, the control unit 208 sends the determined conveying speed to the conveyance drive unit 204, and instructs the conveying unit 203 to perform conveyance processing at the above conveying speed. Additionally, the control unit 208 instructs the head drive unit 206 to drive the ink jet head 205 so that the ink jet head 205 may perform discharge processing at a timing at which droplets of the determined maximum ink droplet number (the first maximum ink droplet number or the second maximum ink droplet number) may be discharged onto the same line of the printing paper.

In Step S9, the control unit 208 makes the head drive unit 206 perform discharge control with the maximum ink droplet number on the ink jet head 205, based on the printing target image data, and makes the conveying unit 203 convey the printing paper at the instructed conveying speed via the conveyance drive unit 204. Accordingly, the conveyance processing of the printing paper is performed so that a discharge operation of an ink droplet number corresponding to each pixel position may be performed at a position within the printing paper corresponding to the above pixel position.

In Step S10, the control unit 208 determines whether or not the printing processing of all the pages is completed. When the printing processing is not completed, the processing returns to Step S9, and when the printing processing is completed, this processing is ended.

Second Embodiment

In the present embodiment, the description of the configuration and functions identical or similar to those of the first embodiment will be omitted, and different configuration and functions will mainly be described.

Configuration of Printing System

The image processor 2021 according to the present embodiment determines whether or not the pixel numbers corresponding to the ink droplet numbers are equal to or smaller than a predetermined threshold value in all pages with respect to all the color components in order of a greater ink droplet number from the first maximum ink droplet number, based on the ink droplet number distribution data. Here, the predetermined threshold value is determined by experimentally obtaining whether the quality of an image becomes better than a predetermined quality up to a certain threshold value in advance, with respect to a plurality of pieces of various printing target data.

The image processor 2021 determines, as the second maximum ink droplet number, a greatest ink droplet number among ink droplet numbers which are ink droplet numbers equal to or smaller than the first maximum ink droplet number and of which pixel numbers are not equal to or less than the predetermined threshold value, based on the above determination result.

For example, in FIGS. 4A and 4B among FIGS. 4A to 4C illustrating ink droplet number distribution data generated regarding print job data of page number 1, when the predetermined threshold value is smaller than a pixel percentage of 5%, since an ink droplet number of which the pixel percentage is equal to or smaller than the predetermined threshold value with the first maximum ink droplet number 7 is ink droplet number 7, 6 may be the second maximum ink droplet number. Meanwhile, in FIG. 4C, the first maximum ink droplet number 7 is used as it is as the ink droplet number of which the pixel percentage is less than the predetermined threshold value.

The image processor 2021 matches the second maximum ink droplet number with an allocation target pixel, which is a pixel of which the pixel number is equal to or greater than a predetermined value (for example, 1) and of which an ink droplet number (ink droplet number of first maximum ink droplet number to second maximum ink droplet number+1) is smaller than the predetermined threshold value, within the printing target image data, and allocates a difference value between an ink droplet number corresponding to the allocation target pixel and the second maximum ink droplet number to pixels around the allocation target pixel, to reproduce the printing target image data.

Specific description of this reproduction processing will be performed below. The image processor 2021 detects the pixel position of an allocation target pixel from the distribution (ink droplet numbers with respect to pixel positions) of ink droplet numbers on a first page regarding a C component based on ink droplet number distribution data. The image processor 2021 performs allocation processing on pixel positions around the pixel position of the detected allocation target pixel.

Figure 5:
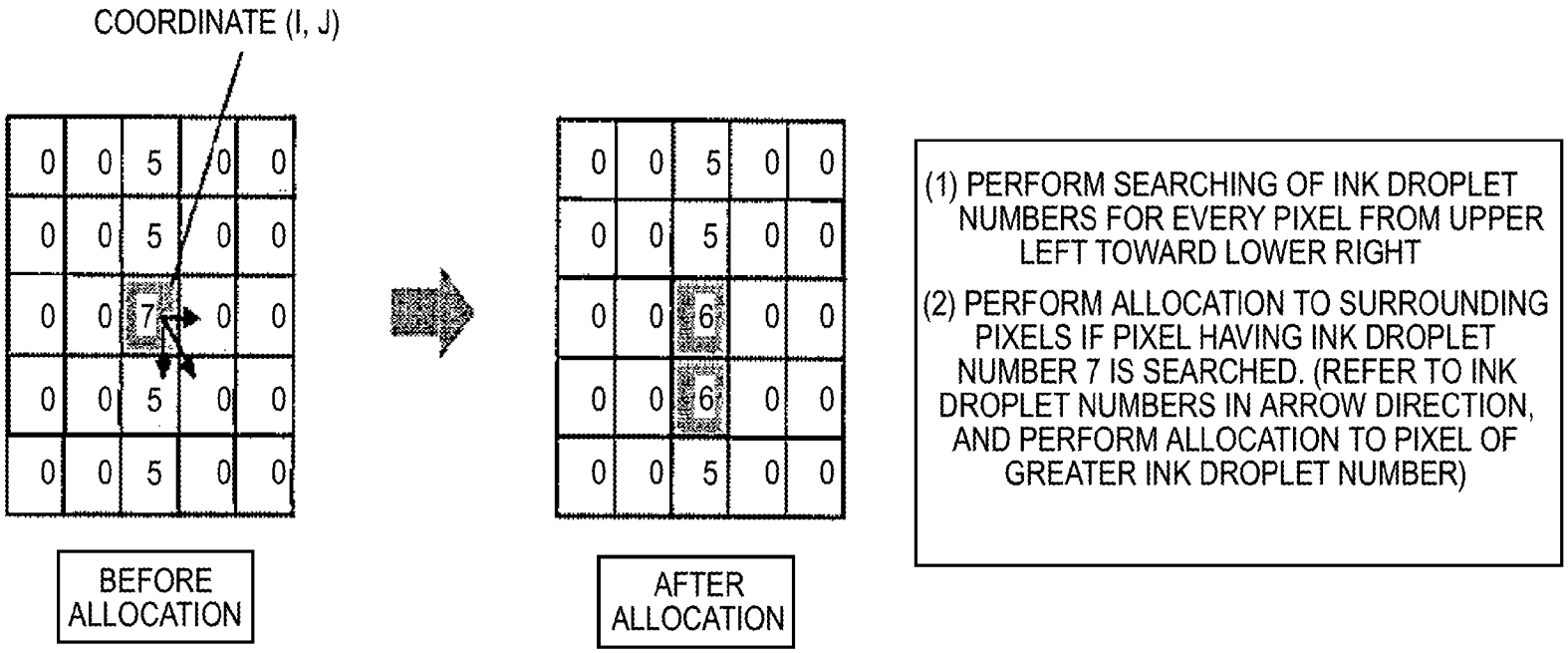
FIG. 5 is a supplementary view for describing allocation processing according to the second embodiment.

FIG. 5 is a supplementary view illustrating an example of the distribution of ink droplet numbers around a pixel position (I, J) of the C component, and illustrating a case where a pixel with ink droplet number 7 is determined as an allocation target pixel and the second maximum ink droplet number is determined as 6.

In this case, an ink droplet number corresponding to the pixel position (I, J) is determined as the second maximum ink droplet number 6, and the difference value 1 between the ink droplet number 7 corresponding to the pixel position (I, J) and the second maximum ink droplet number 6 is allocated to surrounding pixel positions.

A specific example of this allocation method will be illustrated below. The image processor 2021 allocates the difference value 1 in the case of an ink droplet number (ink droplet number of 1 or more and 5 or less) that is smaller than the second maximum ink droplet number−1 and is not 0, based on ink droplet numbers corresponding to eight pixel positions around the pixel position (I, J). When there are a plurality of pixel positions that are targets to be allocated, allocation is made to a pixel position with a greater ink droplet number. When there is no pixel position to be allocated, the same processing is then performed based on ink droplet numbers of nearby pixel positions (I, J) (specifically, pixel positions apart by two pixels from the pixel position (I, J)).

When the ink droplet numbers of the above nearby pixel positions are searched a predetermined number of times and there is no pixel position to be allocated, the above difference value 1 is not allocated to any pixel positions. However, in this case, allocation may be made to pixel positions that are adjacent to the pixel position (I, J) and have ink droplet number 0. In this case, a region to be allocated to the pixel positions having ink droplet number 0 may be limited to a predetermined area (the area of a region of predetermined pixels).

The image processor 2021 also performs the same processing regarding the remaining pages regarding the C component, and the other color M to K components. In addition, this allocation processing is an example, and other processing may be performed as long as degradation of image quality caused by reducing an ink droplet number of a pixel position that is a target to be allocated may be prevented with respect to an original image.

The control unit 208 calculates a difference time obtained by subtracting a time when printing of all the pages of the printing paper is completed at a conveying speed corresponding to the second maximum ink droplet number from a time when printing of all the pages (all the pages of the received print job data) of the printing paper is completed at a conveying speed corresponding to the first maximum ink droplet number.

The specific description of this calculation processing will be illustrated below. The time required until the printing target image data is generated and paper feed is started after a printing instruction for a print job is input is a value determined by the print job, and is a value that does not change depending on a change in the maximum ink droplet number. Additionally, since the ink droplet number distribution calculation processing may be performed in the case of the printing target image data generation processing, it takes little time. Additionally, since the determination processing whether or not a pixel number falls within the predetermined threshold value, and the maximum ink droplet number determination processing are also performed based on the ink droplet number distribution data and are not processing in units of pixels, it takes little time.

However, since the processing of reproducing the printing target image data is performed separately from the generation processing of the printing target image data, searching processing in units of all the pixels included within a plurality of pages of printing target data is separately required, and allocation processing is required according to pixels. Therefore, more time is required for this reproduction processing compared to the ink droplet number distribution calculation processing and so on.

For this reason, a change in the conveying speed based on the maximum ink droplet number and the reproduction processing of the printing target image data to be described below greatly influence a change in print job completion time in accordance with a change in the maximum ink droplet number. The conveying speed is changed in accordance with the change in the maximum ink droplet number to execute a print job as long as the time required for the reproduction processing is shorter than the decreased time of conveyance time based on the change in the maximum ink droplet number, based on the comparison between a change in the conveyance time based on the change in the maximum ink droplet number and the time required for the reproduction processing of the printing target image data. Accordingly, the print job completion time is also accelerated while making printing image quality excellent.

The control unit 208 determines the conveying speed from the first maximum ink droplet number, the length of the paper in the conveying direction included in the print job data, and the side information with reference to the second correspondence table. Then, the control unit 208 calculates the time (hereinafter, first printing completion time) when the printing of all the pages of the printing paper is completed at a conveying speed corresponding to the first maximum ink droplet number from a page number included in the print job data and the determined conveying speed.

Similarly, the control unit 208 calculates the time (hereinafter, second printing completion time) when the printing of all the pages of the printing paper is completed at a conveying speed corresponding to the second maximum ink droplet number, based on the second maximum ink droplet number. The control unit 208 calculates a difference time obtained by subtracting the second printing completion time from the first printing completion time.

The control unit 208 determines whether or not a reproduction time required for reproducing the printing target image data by the image processor 2021 is smaller than the calculated difference time. Specific description of this processing will be performed below.

A prediction time table showing a time predicted to be required for reproducing the printing target image data according to the page number, the size of the printing paper, and the print resolution is stored in advance in the storage unit 207. An example of a generation method of this prediction time table will be illustrated below.

The control unit 208 generates the prediction time table by classifying a time required for performing the reproduction processing of the printing target image data, according to the range of the page number, the size of the printing paper to be printed on, and the print resolution after the ink droplet number distribution calculation processing, the pixel number determination processing, and the maximum ink droplet number determination processing are performed on a plurality of pieces of printing target image data in advance. Then, the control unit 208 makes the generated prediction time table be stored in the storage unit 207. The control unit 208 determines the time corresponding to the page number and the size of the printing paper included in the printing target image data, and the print resolution set in the control unit 208, as the reproduction time, with reference to the prediction time table. The control unit 208 determines whether or not the determined reproduction time is smaller than the calculated difference time.

When it is determined by a difference time determination function that the determined reproduction time is smaller than the difference time, the control unit 208 makes the image processor 2021 perform reproduction processing and controls the head drive unit 206 and the conveyance drive unit 204 based on the second maximum ink droplet number.

Ink Jet Printing Method

Figure 6:
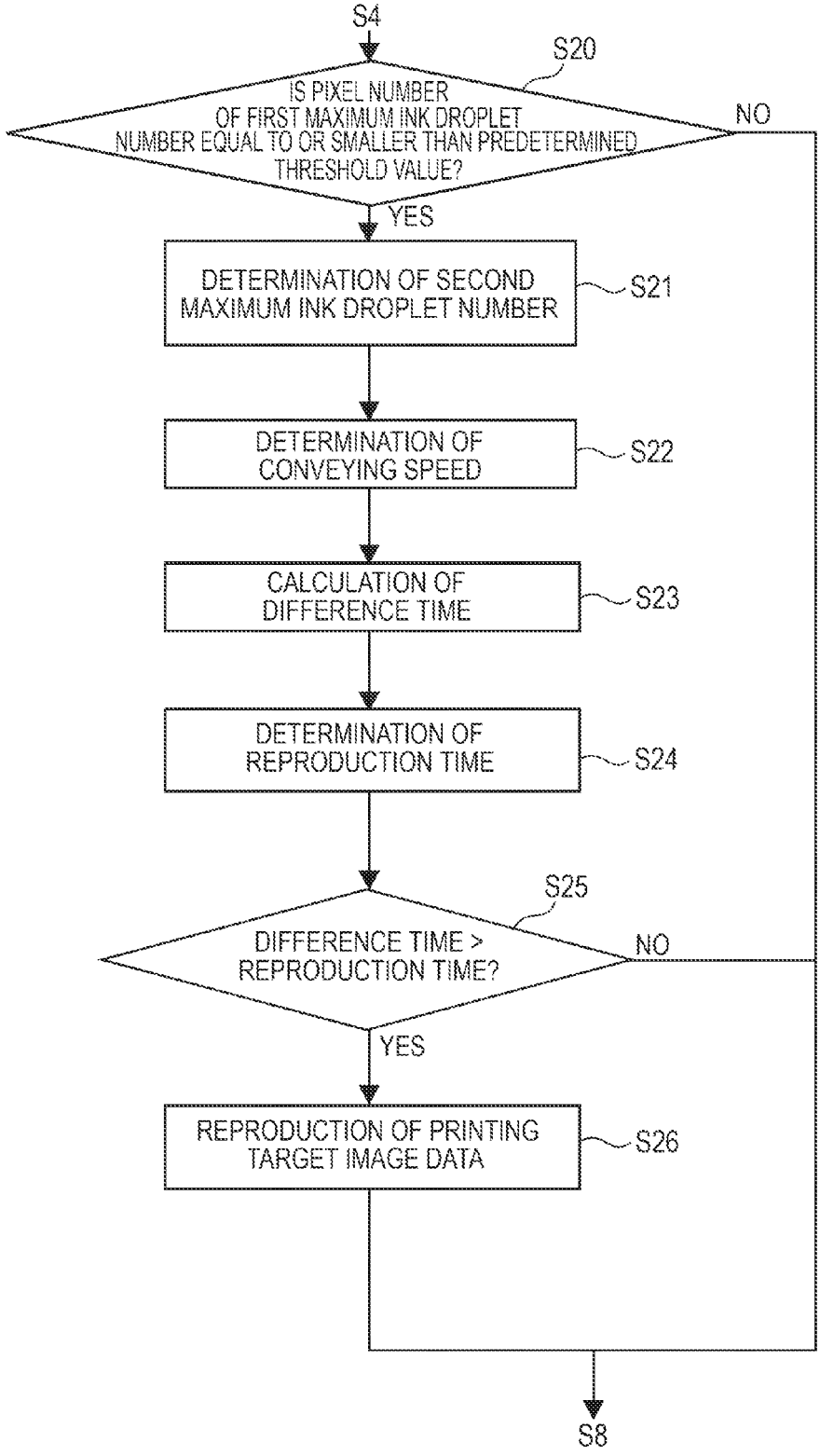
FIG. 6 is a flowchart illustrating an ink jet printing method according to the second embodiment.

FIG. 6 is a flowchart illustrating a printing method according to the second embodiment. In the present embodiment, the following processing is performed instead of the processing of Steps S5 to S7 in the flowchart illustrated in FIG. 3.

In Step S20, the image processor 2021 determines whether or not the pixel number of the first maximum ink droplet number is equal to or smaller than a predetermined threshold value in all pages regarding the C, M, Y, and K components.

When the pixel number is determined to be equal to or smaller than the predetermined threshold value, the processing shifts to Step S21. When the pixel number is determined not to be equal to or smaller than the predetermined threshold value, the processing shifts to Step S8.

In Step S21, the image processor 2021 determines, as the second maximum ink droplet number, a greatest ink droplet number among ink droplet numbers which are ink droplet numbers equal to or smaller than the first maximum ink droplet number and of which pixel numbers are not equal to or less than the predetermined threshold value, based on the result determined in Step S20, and sends a determined second maximum ink droplet number to the control unit 208.

In Step S22, the control unit 208 determines a conveying speed corresponding to the second maximum ink droplet number, the length of the paper in the conveying direction included in the printing target image data, or the like, with reference to the second table stored in the storage unit 207.

In Step S23, the control unit 208 calculates a difference time obtained by subtracting a time when printing of all the pages of the printing paper is completed at a conveying speed corresponding to the second maximum ink droplet number from a time when printing of all the pages of the printing paper is completed at a conveying speed corresponding to the first maximum ink droplet number.

In Step S24, the control unit 208 determines the time corresponding to the page number and the size of the printing paper included in the printing target image data, as the reproduction time, with reference to the prediction time table.

In Step S25, the control unit 208 determines whether or not the determined reproduction time is smaller than the difference time calculated in Step S23. The control unit 208 shifts to Step S8 when it is determined by a difference time determination function that the determined reproduction time is greater than the difference time. When it is determined by the difference time determination function that the determined reproduction time is smaller than the difference time, the control unit 208 makes the image processor 2021 perform the reproduction processing in Step S26. Thereafter, the processing shifts to Step S8.

Modification Example 1

In the above-described first and second embodiments, the image processor 2021 may be adapted to generate the printing target image data based on different print resolutions according to the color components.

The ink jet head 205 may perform printing on the printing paper by discharging ink, having ink droplet numbers corresponding to the respective pixels, to positions on the printing paper corresponding to the respective pixels in the printing target image data, for every color component, with a maximum ink droplet number determined based on the printing paper and the print resolution as an upper limit.

The control unit 208 may be adapted to determine the conveying speed of the printing paper during the printing processing performed by the ink jet head 205, using a maximum ink droplet number, which is greatest among maximum ink droplet numbers determined for every color component, as the above-described first maximum ink droplet number.

For example, when the print resolution of an ink jet head for the K component is 600 DPI and the print resolutions of ink jet heads for the CMY components are 300 DPI, the pixel numbers of the printing target image data of the K component are different from the pixel numbers of the printing target image data of the CMY components.

In such a case, if maximum dischargeable droplet numbers per one pixel of the CMYK components are made the same while ink discharge amounts per one droplet remain the same, an unidentifiable state also occurs and image quality degradation occurs, due to ink blurring or the like between adjacent pixels. Therefore, as described above, according to the respective color components, the print resolutions of the ink jet heads may be changed and the maximum dischargeable droplet number may be changed. In the present modification example, application examples in that case will be described.

Additionally, the control unit 208 holds the print resolutions of the ink jet heads for the respective color components. In the case of the present modification example, the paper type, the print resolution, and the maximum ink droplet number are associated in the first table.

Description of a printing method of the present modification example will be performed with reference to FIGS. 3 and 6. In addition, the description of the same processing as the above-described embodiment will be omitted. In Step S2, the control unit 208 determines maximum ink droplet numbers of the respective color components from the paper type information and the print resolutions of the respective color components included in the print job data, with reference to the first table. Then, the control unit 208 determines a greatest value among the maximum ink droplet numbers of the respective color components as the above-described first maximum ink droplet number.

In Step S8, the control unit 208 controls the head drive unit 206 so that the head drive unit 206 may perform discharge processing at a timing at which droplets of the determined first maximum ink droplet number or the second maximum ink droplet number or droplets of the maximum ink droplet numbers of the respective color components may be discharged.

Here, as for the print resolution in the prediction time table in the second embodiment, when the print resolutions vary according to the respective color components, recording is performed as it is with print resolutions according to the color components.

Modification Example 2

(1) The above-described embodiments may also be similarly applied to modes in which printing density is reduced and printed, such as a thinning-out setting mode and an ink-saving mode, are included in the print job data. Since these modes reduce the printing density overall, when these modes are included, the above-described embodiments may be applied such that the maximum ink droplet number is lowered by a predetermined value.

(2) Although the case of face-up paper ejection has been described in the above-described embodiments and the modification example, the above-described embodiments and the modification example are not limited to this, and may also be similarly applied to, for example, a case where the ink droplet number distribution within the printing target image data is calculated, and the conveying speed is changed based on whether or not the maximum ink droplet number is changed, in the case of face-down paper ejection.

In addition, in a face-down paper ejection method, printing may be started even if all-page RIP processing is not performed. Application of the face-down paper ejection method is limited to a case where processing becomes faster in a case where the all-page RIP processing is performed, a maximum ink droplet number is changed, and conveying and printing are performed at a conveying speed corresponding to the maximum ink droplet number than in case where RIP processing is performed page by page, and processing is performed at a conveying speed corresponding to a determined maximum ink droplet number. Thus, it may be said that applicable cases of the face-down paper ejection method are not so many. Meanwhile, in the case of the face-up paper ejection method, printing is not started unless the all-page RIP processing is not performed. Thus, it may be said that there are more cases where the printing processing is accelerated by a change in the conveying speed accompanying a change in the maximum ink droplet number than the face-down paper ejection method. Thus, it may be said that the effect of the invention is great.

(3) In Modification Example 2, when the fact in which the maximum dischargeable droplet number of the K component is the greatest regarding the printing target image data of the maximum dischargeable droplet numbers for the respective color components, there are many regions where the pixel values of the respective pixels of the printing target image data of the K component are high, and there are few regions where the pixel values of the respective pixels of the printing target image data of the other components are high is known by preview display or the like of the input/output unit 106 of the terminal device 100 or the like, Steps S2 to S8 may be performed only with regards to the K component.

(4) In the above-described embodiments, the terminal device generates the print job data. However, the invention is not limited to this. The present embodiments may also be applied to a case where the print job data is generated by reading an original document by the ink jet printing apparatus 200 and inputting various data by a user.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An ink jet printing apparatus comprising:

a generation unit configured to generate printing target image data including an image page, on which ink droplet numbers are recorded for respective pixels, according to a print resolution for every page and every color component;

a printing unit configured to perform printing on a printing paper by discharging ink, having ink droplet numbers corresponding to the respective pixels with a first maximum ink droplet number determined based on the printing paper as an upper limit, to positions on the printing paper corresponding to the respective pixels in the printing target image data;

a conveying speed determination unit configured to determine a conveying speed of the printing paper during printing processing performed by the printing unit, based on the first maximum ink droplet number;

an ink droplet number distribution calculation unit configured to calculate a distribution of the ink droplet numbers for every page and every color component when the printing target image data is generated by the generation unit;

a pixel number determination unit configured to determine whether or not pixel numbers corresponding to the ink droplet numbers are equal to or smaller than a predetermined threshold value in all color components and all pages in order of a greater ink droplet number from the first maximum ink droplet number, based on the distribution of the ink droplet numbers of all the pages calculated by the ink droplet number distribution calculation unit;

a maximum ink droplet number determination unit configured to determine, as a second maximum ink droplet number, a greatest ink droplet number among ink droplet numbers which are ink droplet numbers equal to or smaller than the first maximum ink droplet number and of which pixel numbers are not equal to or less than the predetermined threshold value, based on a determination result obtained by the pixel number determination unit;

a difference time calculation unit configured to calculate a difference time obtained by subtracting a time when printing of all the pages of the printing paper is completed at a conveying speed corresponding to the second maximum ink droplet number from a time when printing of all the pages of the printing paper is completed at a conveying speed corresponding to the first maximum ink droplet number;

a reproduction unit configured to associate the second maximum ink droplet number with an allocation target pixel, which is a pixel corresponding to an ink droplet number that is greater than the second maximum ink droplet number and of which the pixel number is equal to or greater than a predetermined value, within the printing target image data, and allocating a difference value between an ink droplet number corresponding to the allocation target pixel and the second maximum ink droplet number to pixels around the allocation target pixel, to reproduce the printing target image data;

a difference time determination unit configured to determine whether or not a reproduction time required for reproducing the printing target image data by the reproduction unit is smaller than the difference time calculated by the difference time calculation unit; and a control unit configured to, when it is determined by the difference time determination unit that the reproduction time is smaller than the difference time, make the reproduction unit perform reproduction processing and controlling the printing unit and the conveying speed determination unit based on the second maximum ink droplet number.

2. The ink jet printing apparatus according to claim 1, wherein the generation unit generates the printing target image data based on different print resolutions according to the color components, wherein the printing unit discharges the ink, having the ink droplet numbers corresponding to the respective pixels, to positions on the printing paper corresponding to the respective pixels in the printing target image data, for every color component, with a maximum ink droplet number determined based on the printing paper and the print resolution as an upper limit, to perform printing on the printing paper, and wherein the conveying speed determination unit determines the conveying speed of the printing paper during the printing processing performed by the printing unit, using the maximum ink droplet number, which is greatest among maximum ink droplet numbers determined for every color component, as the maximum ink droplet number.

3. The ink jet printing apparatus according to claim 2, wherein a page number of an image page, the size of the printing paper to be printed on, and the print resolution are included in the printing target image data, wherein the inkjet printing apparatus further comprises:

a storage unit configured to store therein a prediction time table showing a time predicted to be required for reproducing the printing target image data by the reproduction unit according to the page number of the image page, the size of the printing paper, and the print resolution, and wherein the difference time determination unit determines a time corresponding to the page number, the size of the printing paper, and the print resolution, which are included in the printing target image data, as the reproduction time, with reference to the prediction time table.

4. The ink jet printing apparatus according to claim 3, further comprising:

a prediction time table generation unit configured to generate the prediction time table by classifying a time required for performing the reproduction processing by the reproduction unit, according to the page number of the image page, the size of the printing paper, and the print resolution after the processing of the ink droplet number distribution calculation unit, the pixel number determination unit, and the maximum ink droplet number determination unit is performed on a plurality of pieces of printing target image data in advance, wherein the prediction time table generated by the prediction time table generation unit is stored in the storage unit.

5. The ink jet printing apparatus according to claim 1, wherein a page number of an image page, the size of the printing paper to be printed on, and the print resolution are included in the printing target image data, wherein the inkjet printing apparatus further comprises:

a storage unit configured to store therein a prediction time table showing a time predicted to be required for reproducing the printing target image data by the reproduction unit according to the page number of the image page, the size of the printing paper, and the print resolution, and wherein the difference time determination unit determines a time corresponding to the page number, the size of the printing paper, and the print resolution, which are included in the printing target image data, as the reproduction time, with reference to the prediction time table.

6. The ink jet printing apparatus according to claim 5, further comprising:

a prediction time table generation unit configured to generate the prediction time table by classifying a time required for performing the reproduction processing by the reproduction unit, according to the page number of the image page, the size of the printing paper, and the print resolution after the processing of the ink droplet number distribution calculation unit, the pixel number determination unit, and the maximum ink droplet number determination unit is performed on a plurality of pieces of printing target image data in advance, wherein the prediction time table generated by the prediction time table generation unit is stored in the storage unit.

* * * * *